US007676858B2

(12) United States Patent
Halloran et al.

(10) Patent No.: US 7,676,858 B2
(45) Date of Patent: Mar. 16, 2010

(54) FLUSH VALVE

(75) Inventors: Daniel N. Halloran, Saukville, WI (US); Douglas E. Bogard, Kohler, WI (US); Peter W. Denzin, Glenbalah, WI (US); Sudip Mukerji, Cedarburg, WI (US)

(73) Assignee: Kohler Co., Kohler, WI (US)

( * ) Notice: Subject to any disclaimer, the term of this patent is extended or adjusted under 35 U.S.C. 154(b) by 305 days.

(21) Appl. No.: 11/064,117

(22) Filed: Feb. 22, 2005

(65) Prior Publication Data

US 2006/0185068 A1 Aug. 24, 2006

(51) Int. Cl.
*E03D 1/34* (2006.01)

(52) U.S. Cl. ..... 4/378

(58) Field of Classification Search ..... 4/378, 4/393, 392, 415, 382, 397
See application file for complete search history.

(56) References Cited

U.S. PATENT DOCUMENTS

| | | | | | |
|---|---|---|---|---|---|
| 1,307,391 | A | * | 6/1919 | Bush | 4/378 |
| 1,310,497 | A | * | 7/1919 | Keenan | 4/378 |
| 1,570,681 | A | * | 1/1926 | Kirkham | 4/378 |
| 2,277,388 | A | * | 3/1942 | Clark | 251/363 |
| 2,726,403 | A | * | 12/1955 | De Gree | 4/393 |
| 2,779,028 | A | * | 1/1957 | Branch | 4/393 |
| 2,940,084 | A | * | 6/1960 | Fabbi et. al. | 4/327 |
| 2,971,201 | A | * | 2/1961 | Kurkoske | 4/333 |
| 3,939,507 | A | * | 2/1976 | Clark | 4/327 |
| 4,106,136 | A | | 8/1978 | Lippincott, Sr. | |
| 4,172,299 | A | | 10/1979 | del Pozo | |
| 4,433,446 | A | | 2/1984 | Grimstad | |
| 4,471,499 | A | | 9/1984 | Troman et al. | |
| 4,840,196 | A | | 6/1989 | Antunez | |
| 5,195,190 | A | | 3/1993 | Nguyen-Huu | |
| 5,218,725 | A | | 6/1993 | Lipman | |
| 5,325,547 | A | | 7/1994 | Pino | |
| 5,848,442 | A | * | 12/1998 | Denzin | 4/395 |
| 5,926,861 | A | * | 7/1999 | Frost | 4/378 |
| 6,178,567 | B1 | | 1/2001 | Bliss | |
| 6,401,269 | B1 | | 6/2002 | Andersen et al. | |
| 6,651,264 | B2 | | 11/2003 | Halloran et al. | |
| 6,785,914 | B2 | | 9/2004 | Kimura | |

FOREIGN PATENT DOCUMENTS

| | | |
|---|---|---|
| EP | 0107974 | 5/1984 |
| FR | 2711689 A | 5/1995 |
| FR | 2740794 A | 5/1997 |
| GB | 2130342 | 5/1984 |
| RU | 215594 | 9/2000 |

* cited by examiner

*Primary Examiner*—Huyen Le
(74) *Attorney, Agent, or Firm*—Quarles & Brady LLP

(57) ABSTRACT

A flush valve for a toilet has a valve body with a flow passage that narrows non-linearly down from the valve seat. The flow passage is formed by a surface that follows a polynomial expression so as to define a computationally derived flow profile that more closely follows the narrowing exhibited by falling water as it accelerates under gravity. The non-linear flow profile of the valve reduces the presence of air in the valve after a flush cycle is initiated so that greater flush efficiency can be achieved. The flush valve can also have a wide mouth overflow that narrows to improve flow in an overflow situation.

16 Claims, 4 Drawing Sheets

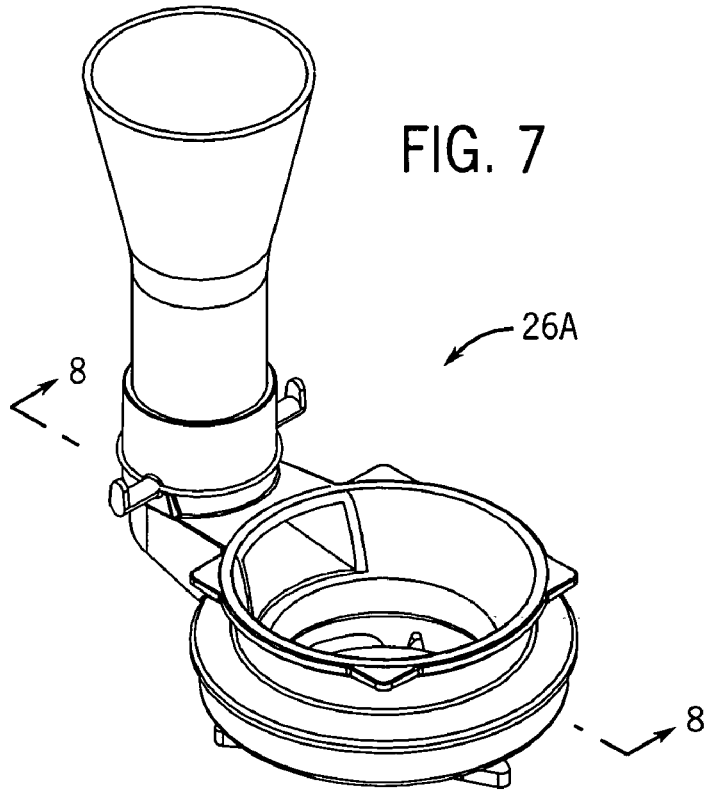
FIG. 7
FIG. 8
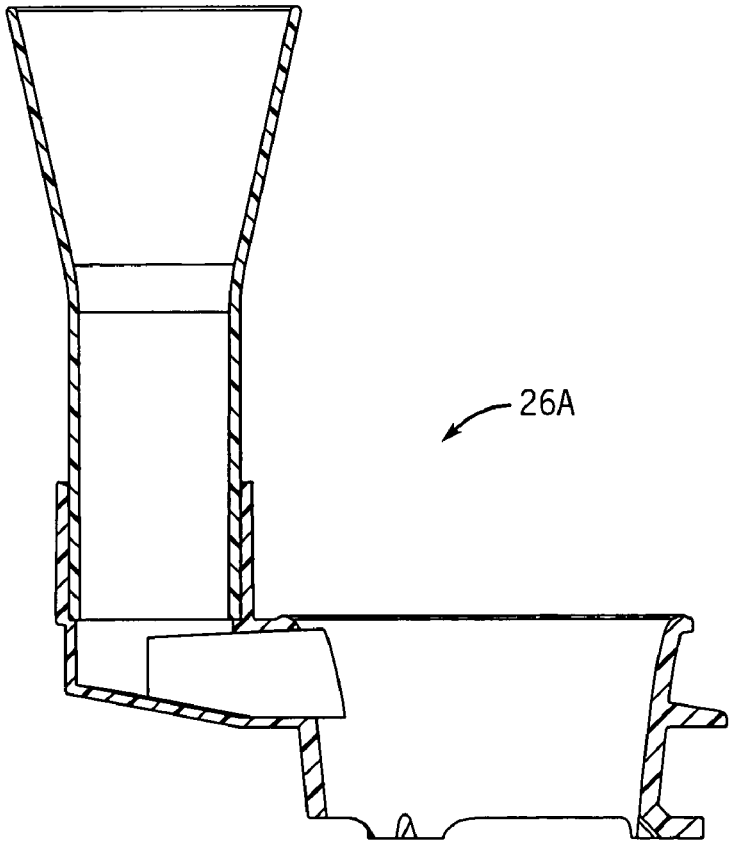

FLUSH VALVE

CROSS-REFERENCE TO RELATED APPLICATION

Not applicable.

STATEMENT OF FEDERALLY SPONSORED RESEARCH OR DEVELOPMENT

Not applicable.

BACKGROUND OF THE INVENTION

The present invention relates to flush valves that control the flow of water from toilet tanks to toilet bowls, and in particular, to flush valves with improved flow characteristics.

Systems for controlling the flush of toilet tank water to a toilet bowl are known, see e.g. U.S. Pat. Nos. 4,172,299 and 6,178,567. Such systems have a water inlet valve for the tank that is typically controlled by a float that senses tank water level. A flapper controls the flow of the tank water through an outlet at the bottom of the tank. Depressing the trip lever unseats the flapper so that water can empty from the tank into the bowl. As the tank water drains, the float drops with the water level in the tank, thereby triggering inlet water flow. The water level drops faster than the inlet water enters so that the flapper can drop down to reseal the outlet, and the water level in the tank can be re-established. As the tank refills, the float rises with the water and eventually closes the inlet valve to shut off the water supply.

The ability of the toilet, particularly low water consumption toilets, to operate efficiently during a flush cycle is largely a function of the pathway through which the water has to travel to exit the toilet. This pathway runs from the flush valve and through the vitreous path of the bowl. Various trapway configurations have been devised to optimize flow characteristics during the flush cycle.

Relatively little of the prior efforts to improve flush performance has been to address the impact of the tank flush valve. Conventional flush valves typically have a circular opening with a cylindrical passage leading down to the outlet of the tank, see e.g., U.S. Pat. No. 5,325,547. The cylindrical construction of such valves may create an air pocket in the flow pathway after a flush is initiated because the water in the tank narrows as it accelerates under gravity through the valve. Flush valves with non-cylindrical passageways have been devised. For example, U.S. Pat. No. 5,195,190 discloses a flush valve with a passageway in the form of conical section. The decreasing diameter of the passageway in such a valve helps reduce the volume of unwanted air. However, while an improvement, the frusto-conical passageway provides less than optimal flush efficiency.

Another part of the flush valve that can have low flow efficiency is the overflow. The overflow is used in the toilet to provide a drain passage for excess water in the tank that may arise if the water supply was not shut off in time, for example by failure of the inlet seal or the float tripping the inlet valve too late. The overflow connects to the outlet of the flush valve so that excess water can pass into the bowl and to the waste plumbing lines. Conventional overflow tubes are long upright cylinders with the lower end communicating with the main flow passage of the flush valve and the upper end extending slightly above the desired normal full water level in the tank, see e.g. U.S. Pat. No. 4,433,446. Such cylindrical overflow tubes suffer similar less than optimal flow characteristics as do the cylindrical flush valves.

U.S. Pat. Nos. 6,401,269 and 6,651,264 both disclose flush valve assemblies that have stout, rectangular overflow tubes with relatively large mouths at the upper ends and tapering walls. While the wide mouth and narrowing construction do affect flow efficiency relative to conventional cylindrical overflow tubes, the generally rectangular cross-section still provides less than ideal flow.

Thus, a need exists for a flush valve with improved flow characteristics.

SUMMARY OF THE INVENTION

The present invention provides a toilet flush valve that has improved flow characteristics resulting from a flow passage with a non-linearly narrowing flow profile which more closely follows the narrowing exhibited by falling water as it accelerates under gravity. The non-linear flow profile of the valve flow passage reduces the presence of air in the valve after a flush cycle is initiated so that greater flush efficiency can be achieved. The flush valve can also have a narrowing overflow, preferably non-linearly, to similarly improve flow in an overflow situation.

Specifically, in one form the invention provides a flush valve for controlling the flow of water from a toilet water tank. A valve body has a valve seat and a flow passage leading from the valve seat. An inner surface of the valve body that defines the flow passage such that at least a portion of the flow passage narrows non-linearly away from the valve seat. A seal can seat against the valve seat to close off the valve seat. The non-linear surface of the valve body can be computationally derived and expressed as a polynomial equation.

The valve body defines two openings at each end, one at the upper end with the valve seat and another at the lower end that attaches to the outlet of the tank. Given the narrowing of the flow passage, the lower opening is of a lesser dimension than the opening at the valve seat.

The flush valve can have a flapper seal with a hollow inner cavity and a yoke having a pair of legs (each having an opening defining the pivot axis) such that the flapper seal is pivotal with respect to the valve body. The flapper seal and/or the yoke can have an attachment site for attaching a trip connector operable to unseat the flapper seal.

The flush valve can also have an improved overflow. The overflow defines an overflow passage in communication with the flow passage of the valve body that narrows between a wide mouth upper opening of the overflow and a lower opening of the overflow. The overflow passage preferably narrows from its wide mouth for some of its length or all of the way to the lower opening in some way, such as in a funnel shape, or more preferably non-linearly. The overflow can be a separate component and permanently or removably connected to the valve body.

The advantages of the invention will be apparent from the detailed description and drawings. What follows are preferred embodiments of the present invention. To assess the full scope of the invention the claims should be looked to as the preferred embodiments are not intended as the only embodiments within the scope of the invention.

BRIEF DESCRIPTION OF THE DRAWINGS

FIGS. 7 and 8 illustrate another embodiment of the flush valve assembly.

DETAILED DESCRIPTION OF THE PREFERRED EMBODIMENTS

Figure 1:
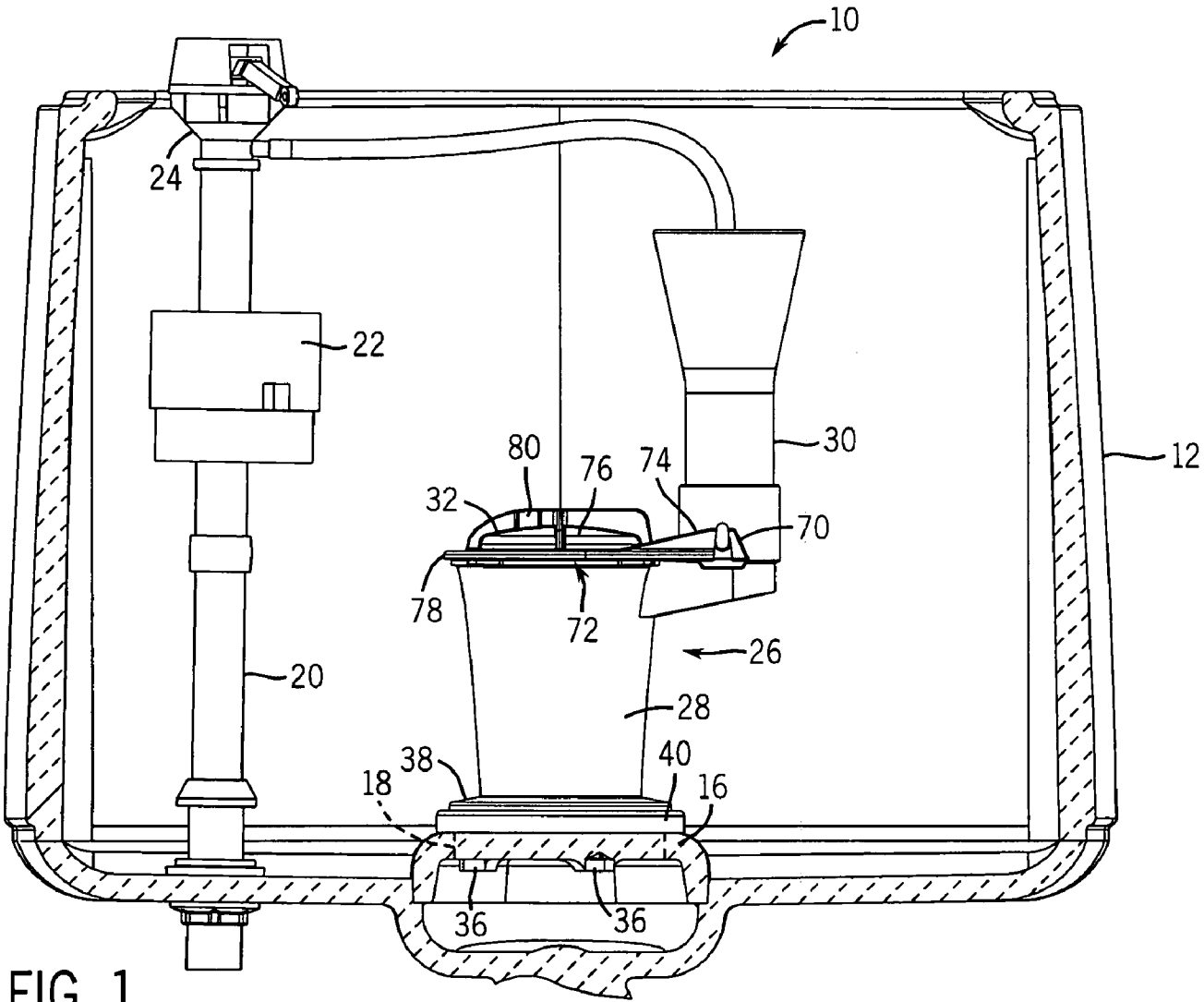
FIG. 1 is a partial sectional front view of a flush valve assembly of the present invention mounted in a toilet tank.
Figure 2:
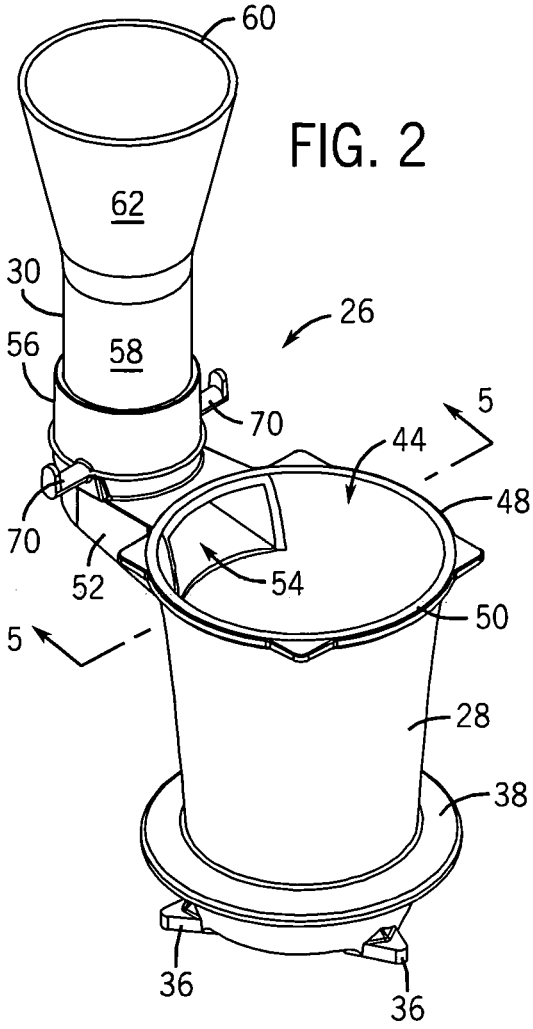
FIG. 2 is a perspective view of the assembly of FIG. 1 shown without a flapper seal attached.
Figure 4:
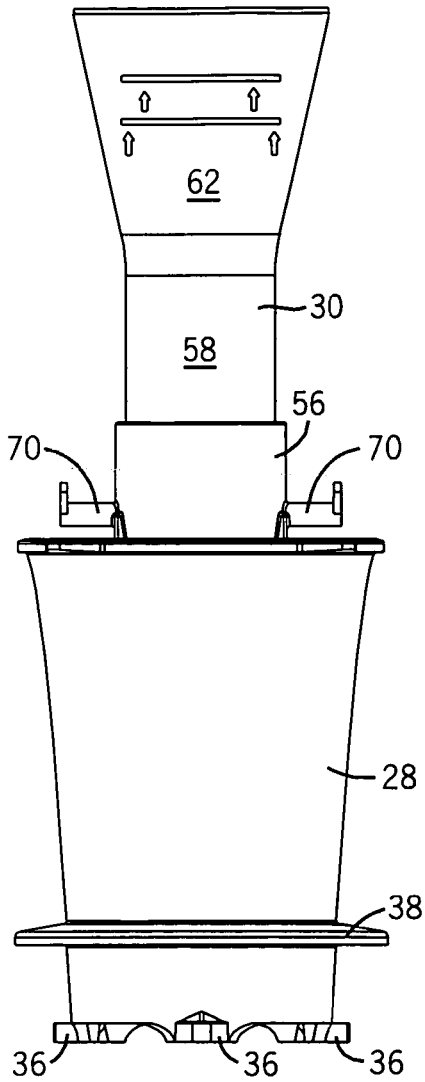
FIG. 4 is an elevational view thereof.
Figure 3:
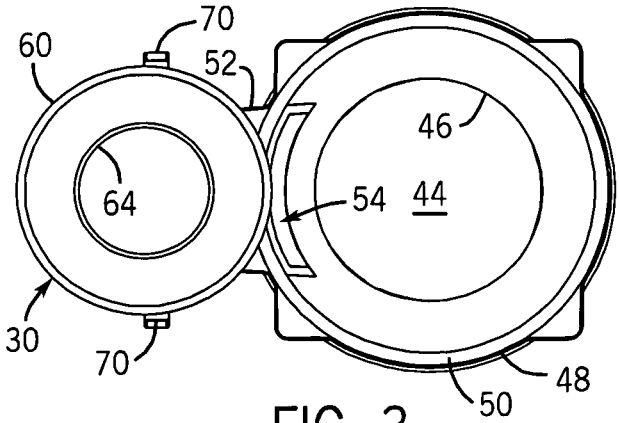
FIG. 3 is a top plan view thereof.

FIG. 1 shows a toilet 10 which includes a water tank 12 and a bowl section (not shown). The tank 12 has a lower horizontal wall 16 with an outlet opening 18, which leads to a channel in an upper rim of the bowl. Mounted inside the tank is the usual water supply pipe 20 with a float 22 operated supply valve 24 for controlling the flow of supply water into the tank 12. A flush valve assembly 26 is mounted inside the tank 12 over the outlet opening 18 to control the flow of water from the tank 12 to the bowl during a flush cycle.

The flush valve assembly 26 is mounted vertically upright in the tank 12 and includes a valve body 28, an overflow tube 30 and a flapper seal 32. The valve body 28 and overflow 30 are preferably a non-corrosive material, such as a suitable plastic. The lower end of the valve body 28 has three prongs 36 that are used to engage an underside of the horizontal wall 16, and an outer flange 38, with a suitable gasket 40, engages an upper side of the wall 16, to mount the flush valve assembly 26 to the tank 12. This connection is similar to that disclosed in U.S. Pat. No. 4,433,446, which is assigned to the assignee of the present invention, and the disclosure of which, particularly FIGS. 2 and 4A-6 and the related description therein, is hereby incorporated by reference.

Figure 5:
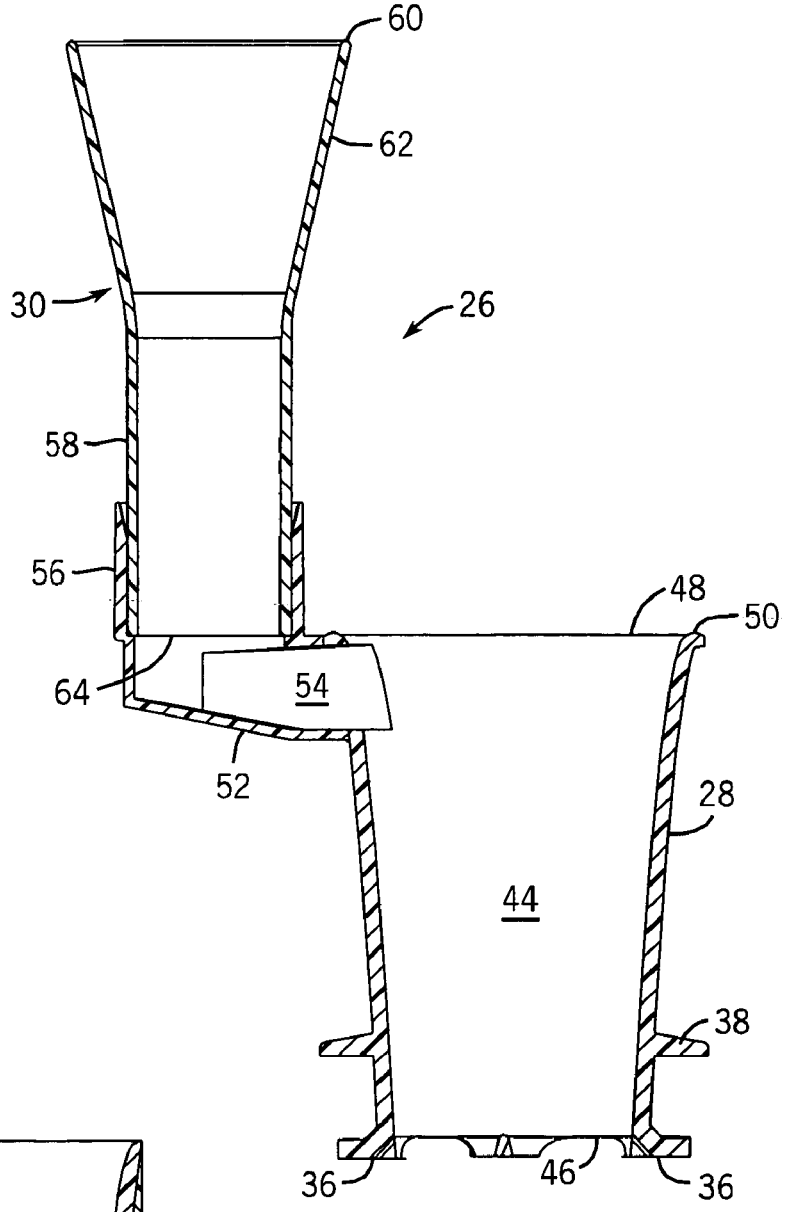
FIG. 5 is a sectional view taken along line 5-5 of FIG. 4.

As shown in FIGS. 1-5, the valve body 28 is hollow and defines a vertical flow passage 44 that runs between a lower opening 46 at the tank outlet 18 and an upper opening 48 at a valve seat 50. The inner surface of the valve body 28 that defines the flow passage 44 has a non-linear profile in vertical cross-section and is circular in horizontal cross-section. As shown in the section view of FIG. 5, the low profile has the greatest diameter at the upper opening 48 and the least at the lower opening 46 to define a continuously narrowing flow passage 44. As shown in FIG. 5, for example, the narrowing is more significant near the upper opening 48 and then becomes more gradual closer to the lower opening 46. It should be noted that even at the upper opening 48, the narrowing is part of the computationally derived non-linear flow profile of the flow passage 44, and is not a simple radius as might be present at the upper edge of conventional flush valves.

As water accelerates from gravity the sectional area of the water decreases. This narrowing occurs non-linearly. The flow profile of the valve is designed to more closely follow the natural path that water takes as it falls under gravity. By forming the flow profile of the valve in this way, less air is present in the flow passage during a flush cycle. Reducing the air in the flow passage promotes a more efficient flush, since the air must otherwise be vented or entrained within the water, which reduces the flush efficiency of the toilet.

Figure 6:
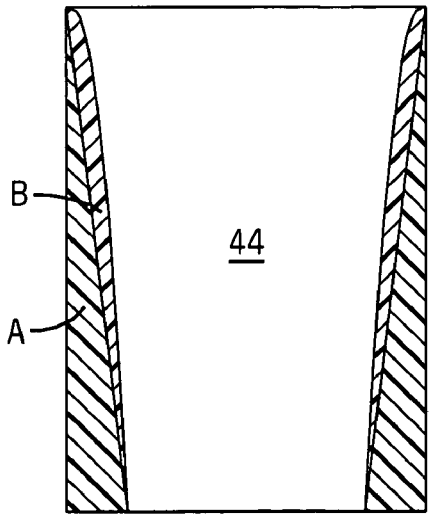
FIG. 6 is a diagram showing the flow profile of the flush valve of the present invention compared to a conical and cylindrical profiles.

As FIG. 6 illustrates, in conventional flush valves with completely cylindrical flow profiles a rather large volume, areas A+B revolved about a vertical centerline of the flow passage, of air is trapped in the flow passage after a flush cycle is initiated in the space between the inner surface of the valve and the surface of the water. Other conventional flush valves have profiles in the form of conical sections, which introduce a lesser volume of air, revolved area B. However, even this air volume adversely impacts flush efficiency. Modeling the flow profile to the natural flow profile of falling water as in the present invention essentially eliminates unwanted air (other than the air in the flow passage prior to flushing), and thus offers improved flush efficiency.

The profile can be computationally derived from a polynomial expression. The expression can vary to suit different parameters, such as a different axial distance between the openings 46 and 48 or different sized openings 46 and 48. In the preferred example of FIGS. 1-5, the polynomial expression can be:

$$y = \frac{D_U}{2} - \frac{(D_U - D_L)}{2}\sqrt{\frac{x}{h}}$$

wherein $D_U$ is the diameter of the upper opening 48 and $D_L$ is the diameter of the lower opening 46 and h is the length of the flow passage 44. However, as mentioned, other computational derived mathematical expressions can be employed to achieve a non-linear flow profile that is optimal for the other parameters of the valve, including such expressions of any order less then or greater than one.

In one standard size (shown in FIGS. 1-5), the upper opening 48 is about 3¼ inches (8.3 cm) in diameter and the lower opening 46 at the tank outlet is about 2⁵⁄₁₆ inches (5.9 cm) in diameter, with the upper opening 48 up vertically about 5 inches (12.7 cm) from the lower opening 46. In another standard size of the flush valve 26A (shown in FIGS. 7-8), the upper opening is about 3⅜ inches (8.6 cm) in diameter and about 1¾ inches (4.5 cm) above the lower opening which is about 2¾ inches (7 cm) in diameter. While these are two preferred examples, the valve opening can be at least 2 to 4 inches (5 to 10 cm) in diameter, the lower opening can be at least 2 to 3 inches (5 to 7.6 cm) in diameter, provided the lower opening is less than the valve opening, and the two openings can be at least 1 to 6 inches (2.5 to 15.25 cm) apart.

Referring again to FIGS. 1-5, the valve body 28 has an extension 52 at one side that defines a channel 54 in communication with the flow passage 44 below the valve seat 50. The extension 52 forms a socket 56 where the overflow 30 connects to the valve body 28. The socket 56 makes a surface seal fit with the outside of a lower cylindrical portion 58 of overflow 30 at about the lower ⅔ of the socket 56. As shown in FIG. 5, the upper ⅓ of the socket 56 is chamfered to form a well for adhesive that can be applied around the joint to secure a mechanical connection.

The overflow 30 defines an overflow passage 58 in communication with the flow passage 44 of the valve body 28 through the channel 54 of the extension 52. The overflow 30 has a wide mouth upper opening 60 and narrows at an upper portion 62 to the cylindrical portion 58 with a lower opening 64, with circular horizontal cross-sections throughout. The inner surface of the overflow 30 at the tapered upper portion 62 preferably defines a non-linearly narrowing overflow passage so that flow benefits can be gained similar to that through the flow passage 44. Also like the flow passage 44, a suitable polynomial expression can be used to define the inner wall of the overflow to arrive at a preferred non-linearly narrowing profile.

However, since the overflow 30 is used for infrequent overflow situations where the flow rate is much less than the typical rate of a flush cycle, the upper portion of the overflow could follow a simple conical section profile, such as a funnel shape, which would be easier to manufacture and yet still provide improved performance over a straight cylindrical profile. In any event, the wide mouth of the upper opening 60 increases the perimeter distance of the overflow to permit a greater volume of excess water to transition quickly from the tank to the overflow passage 58, and then down to waste plumbing.

The upper opening 60 is preferably at least 1½ inches (3.8 cm), and in one standard size (shown in FIGS. 1-5) it is about 2½ inches (6.4 cm), the lower opening 64 is 1⁵⁄₁₆ inches (3.3 cm). The length of the overflow 30 is selected according to the depth of the tank allowing to work with numerous toilet configurations. The exemplary overflow shown in FIG. 1-5 is about 5½ inches (13.3 cm).

Referring again to FIGS. 1-3, the extension 44 also has two pivot arms 70 that extend out from opposite sides to define a pivot axis for the flapper 32. The flapper 32 includes a yoke 72, with a pair of parallel legs 74 (one shown) pivotally coupled to the pivot arms 70, a hollow body 76 with a hollow interior cavity, and a ring 78 for sealing the valve body. The flapper can be made of a single material or co-molded of a composite, with at least the sealing ring being of a material suitable for sealing, for example, ethylene propylene diene monomer (EDPM) or silicone. The flapper 32 has an attachment site 80 for attaching a pull member (not shown), such as a chain or chord which is coupled at its opposite end to a flush actuator (not shown) accessible in the usual manner from outside of the tank 12.

Prior to performing a flush operation, the flush valve is in the position shown in FIG. 1, with the flapper 32 seated on the flush valve seat 50 and water level in the tank 12 is "full". Actuating the flush pulls the flapper 32 upwardly sufficient to cause it to pivot upward and unseat. The flapper 32 is initially held up by the buoyancy force of the water acting on the flapper 32. Water in the tank 12 can flow through the valve body 28 and out through the tank outlet opening 18 to the bowl. Water and waste in the bowl are evacuated to plumbing waste lines in the usual manner through a trap (not shown). When the water in the tank 12 drains low enough, the weight of the flapper 32 causes it to fall under gravity and seat against the valve seat. The flush cycle completes after the tank 12 is refilled with water sufficient to trip the supply valve.

It should be appreciated that merely preferred embodiments of the invention have been described above. However, many modifications and variations to the preferred embodiments will be apparent to those skilled in the art, which will be within the spirit and scope of the invention. Therefore, the invention should not be limited to the described embodiments. To ascertain the full scope of the invention, the following claims should be referenced.

What is claimed is:

1. A flush valve for controlling the flow of water from a toilet water tank, the flush valve comprising:

a valve body having a valve seat defining a first opening and an inner surface defining a flow passage that narrows non-linearly from the valve seat according to a polynomial expression having horizontal and vertical components of different orders to a second opening at a second end opposite the valve seat such that the second opening is of a lesser dimension than the first opening, wherein the inner surface is circular in horizontal cross-section and wherein the inner surface narrows more significantly near the first opening than the second opening and narrows more gradually closer to the second opening; and a seal for seating against the valve seat and closing off the valve seat.

2. The flush valve of claim 1, wherein the first opening is 2 to 4 inches in diameter.

3. The flush valve of claim 1, wherein the second opening is 2 to 3 inches in diameter.

4. The flush valve of claim 1, wherein the axial distance is 1 to 6 inches.

5. The flush valve of claim 1, wherein the first opening is about 3⅜ inches in diameter and the second opening is about 2¾ inches in diameter and the axial distance is about 1¾ inches.

6. The flush valve of claim 1, wherein the first opening is about 3⅜ inches in diameter and the second opening is about 2⁵⁄₁₆ inches in diameter and the axial distance is about 5 inches.

7. The flush valve of claim 1, wherein the seal is a flapper.

8. The flush valve of claim 7, wherein the flapper has a yoke pivotally connected to the valve body.

9. The flush valve of claim 8, wherein the flapper has a hollow inner cavity.

10. The flush valve of claim 1, further including an overflow defining an overflow passage in communication with the flow passage of the valve body, the overflow passage tapering between a first opening and a second opening of a lesser dimension than the first opening.

11. The flush valve of claim 10, wherein first and second openings of the overflow have circular cross sections.

12. The flush valve of claim 10, wherein the overflow is separable from the valve seat.

13. The flush valve of claim 10, wherein at least a portion of the overflow passage narrows away from the first opening of the overflow.

14. A flush valve for a toilet, the flush valve having a valve body with a valve seat and a flow passage leading from the valve seat, the flow passage being formed by a surface defined by a polynomial expression having horizontal and vertical components of different orders such that the flow passage narrows non-linearly from a first opening at a first end with the valve seat to a second opening at a second end opposite the valve seat, wherein the surface forming the flow passage is circular in horizontal cross-section and wherein the surface forming the flow passage narrows more significantly near the first opening than the second opening and narrows more gradually closer to the second opening.

15. A flush valve for a toilet, comprising:

a valve body defining a first opening at a valve seat and a flow passage leading from the first opening to a second opening at an end of the valve body opposite the valve seat, wherein the valve body has an inner surface that defines the flow passage such that it narrows non-linearly from the first opening to the second opening according to a polynomial expression in which horizontal and vertical components thereof are of different orders, wherein the inner surface is circular in horizontal cross-section and wherein the inner surface narrows more significantly near the first opening than the second opening and narrows more gradually closer to the second opening;

a seal for seating against the valve seat and closing the first opening; and an overflow defining an overflow passage in communication with the flow passage of the valve body that narrows between a first opening of the overflow and a second opening of the overflow.

16. The flush valve of claim 15, wherein the overflow passage narrows non-linearly between the first and second openings of the overflow.

* * * * *